US005984328A

United States Patent [19]

Tipton

[11] Patent Number: 5,984,328

[45] **Date of Patent: *Nov. 16, 1999**

[54] TWO-WHEELED SKATEBOARD

[76] Inventor: David W. Tipton, 1668 D. St., Andrews Air Force Base, Md. 20762-2145

[ * ] Notice: This patent issued on a continued prosecution application filed under 37 CFR 1.53(d), and is subject to the twenty year patent term provisions of 35 U.S.C. 154(a)(2).

[21] Appl. No.: 08/637,532

[22] Filed: Apr. 25, 1996

[51] Int. Cl.[6] ..... A63G 17/04

[52] U.S. Cl. ..... 280/87.042; 280/842; 280/7.14

[58] Field of Search ..... 280/87.021, 87.041, 280/87.042, 11.23, 842, 7.12, 7.13, 7.14, 10, 11.28; 16/20, 23

[56] References Cited

U.S. PATENT DOCUMENTS

| | | | |
|---|---|---|---|
| 3,203,706 | 8/1965 | Boyden | 280/87.041 |
| 3,283,358 | 11/1966 | Merriam | 16/20 |
| 4,460,187 | 7/1984 | Shimizu | 280/842 |
| 4,521,029 | 6/1985 | Mayes | 280/87.042 |
| 4,861,054 | 8/1989 | Spital | 280/87.042 |
| 5,125,687 | 6/1992 | Hwang | 280/842 |
| 5,183,277 | 2/1993 | Tang | 280/11.28 |
| 5,312,120 | 5/1994 | Wiegner | 280/11.28 |
| 5,397,138 | 3/1995 | Mangelsdorf | 280/11.28 |
| 5,544,919 | 8/1996 | Tinkler | 280/87.042 |

FOREIGN PATENT DOCUMENTS

| | | | |
|---|---|---|---|
| 2420984 | 11/1979 | France | 280/7.13 |

*Primary Examiner*—J. J. Swann
*Assistant Examiner*—Frank Vanaman

[57] ABSTRACT

A two-wheeled skateboard includes a board which is generally planar between a first position and a second position. A front wheel assembly is attached to the board at the first position and consists of a single front wheel. The front wheel assembly includes a front wheel support connected to the front wheel, a tension member connected to the wheel support and connected to the board at a connected position between the first position and the second position, and a rear wheel assembly attached to the board at the second load bearing position consisting of a single rear wheel. A clevis is connected to the tension member by a first clevis axis and connected to the wheel support by a second clevis axis such that a restoring tension is applied to the front wheel towards a longitudinal axis of the board through the first and second clevis axis while the front wheel assembly pivots with respect to the board. An adjustable member is connected to the elastic tension member and the board such that the amount of force exerted by the tension member on the front wheel support may be increased or decreased through adjustment thereof. The skateboard may optionally provide attachment for a blade assembly and a ski assembly.

29 Claims, 6 Drawing Sheets

10
16
18
20
21
24
25
26
29
30
31
39
42
44
46
48
50
52
54
56
58
60
62
64
90
94
96
98
100
104
106
108

TWO-WHEELED SKATEBOARD

BACKGROUND OF THE INVENTION

1. Field of the Invention

The present invention relates to the art of wheeled foot vehicles. More particularly, the present invention relates to the art of two-wheeled skateboards which do not require lifting of the rider's feet during operation thereof.

2. Description of the Related Art

A number of wheeled foot vehicles are well known in the art. For example, roller skates, roller skis, skateboards and the like are well known and have been enjoyed by countless generations. Wheeled foot vehicles, in the form of roller skates, were used by young children in the late eighteen hundreds. In fact, J. Forsyth patented an improvement in roller skates in 1878 with U.S. Pat. No. 200,186.

During the early nineteen hundreds, boys and girls alike enjoyed riding two-wheeled coasters about their neighborhoods. Youthful interest laid the ground work for invention and by 1918, C. H. Johnson received U.S. Pat. No. 1,274,889 for a coaster having a board, two wheels and a handlebar.

During the early 1960's a number of improvements were made to the conventional "coaster." Adolescents soon discovered that wheeled surfboards or "skateboards" could be constructed by combining a relatively short wooden board with roller skate wheels. The early "roller skate wheels" eventually evolved into modern skateboard wheels which generally incorporate a polyurethane outer surface and sealed bearings. A conventional skateboard is set forth by Brand et al., U.S. Pat. No. 4,181,316, wherein a front wheel mount and a rear wheel mount are permanently affixed to the same side of a generally flat board. A pair of wheels are rotatably affixed about each wheel mount such that the board rests upon four wheels. The four-wheeled construction of Brand et al. provides relative stability at slow velocities and while the skateboard is at rest.

Two-wheeled foot vehicles have existed since at least the 1970's, although they have not been as popular as the more traditional four-wheeled skateboards. Pantzar, U.S. Pat. No. 3,995,873, sets forth a "two-roller" skateboard having a flat board with a pair of steerable rollers disposed about an underside thereof. Each of the two rollers according to Pantzar's are quite substantial in width and at least as great as one half of the overall width of the skateboard. This wide pair of rollers offers stability to the rider at slower speeds and at rest.

Other skateboards have incorporated variations of the two-wheeled skateboard. Barachet, U.S. Pat. No. 5,160,155, sets forth a skateboard having two wheels mounted to an underside thereof. The rear wheel of Barachet is mounted with a fixed axis of rotation relative to the longitudinal axis of the skateboard. However, Barachet suffers from awkward foot placement because the rear wheel protrudes through the surface of the board. Barachet also requires wheels which are exceptionally wide to provide added support to the rider and requires a board which is not substantially planar between the wheel mounts.

Although a number of wheeled foot vehicles exist, young thrill seekers are continually searching for more aggressive and unique ways to develop their acrobatic skills. Further, young skateboard riders find conventional skateboards limiting due to a recurring need to remove the rider's feet from the skateboard in order to propel the skateboard forward.

As a further matter, skateboard technology has conventionally developed around the four-wheeled model.

Accordingly, conventional wheels are generally quite wide in order to provide increased support to the rider.

More recently, roller-skating itself has found renewed interest among young people in the form of "in-line" skating. In-line skating requires a series of in-line wheels rotationally disposed about the bottom of a pair of roller skate boots. This growing trend of in-line skating has increased the technology for in-line wheels and has also created a demand for improvements in two-wheeled skateboards.

SUMMARY OF THE INVENTION

It is therefore an object of the present invention to provide a two-wheeled skateboard which is both aggressive and challenging to ride.

It is a further object of the present invention to provide a two-wheeled skateboard which may be self propelled by the rider without removal of the rider's feet therefrom.

It is a further object of the present invention to provide a two-wheeled skateboard which is both challenging to ride and economical to manufacture.

It is still a further object of the invention to provide a skateboard which remains stable at relatively high speeds.

Objects of the invention are achieved through a two-wheeled foot vehicle including a board which is generally planar between a first position and a second position with a front wheel assembly attached to the board at the first position and consisting of a single front wheel. The front wheel assembly includes a front wheel support connected to the front wheel, a tension member connected to the wheel support and connected to the board at a connected position between the first position and the second position, and a rear wheel assembly attached to the board at the second load bearing position and consisting of a single rear wheel.

Objects of the invention are further achieved through a clevis which is connected to the tension member by a first clevis axis and connected to the wheel support by a second clevis axis such that a restoring tension is applied to the front wheel towards a longitudinal axis of the board through the first and second clevis axis while the front wheel assembly pivots with respect to the board.

Additional objects of the invention are achieved through a caster which includes a plurality of washers or bearings to reduce rotational friction between a front wheel assembly and the board. A wheel durometer hardness is preferably between 84 A and 94 A. A pair of foot pegs extend upwardly from a top surface of the skateboard such that a rider may position the rider's feet adjacent thereto.

Moreover, objects of the invention are achieved by a front blade which is attached to the skateboard through a removable front blade assembly. A rear blade may also be attached to the board by way of a removable rear blade assembly connected to the rear blade and the rear assembly.

The aforementioned and other objects, features, and advantages of the present invention will become readily apparent from the following description of the preferred embodiment(s), as well as from the associated drawings, all of which merely illustrate the inventive concept, and are not in any way intended, nor should they be construed, to limit the scope of the instant invention.

DETAILED DESCRIPTION OF THE PREFERRED EMBODIMENTS

Figure 1:
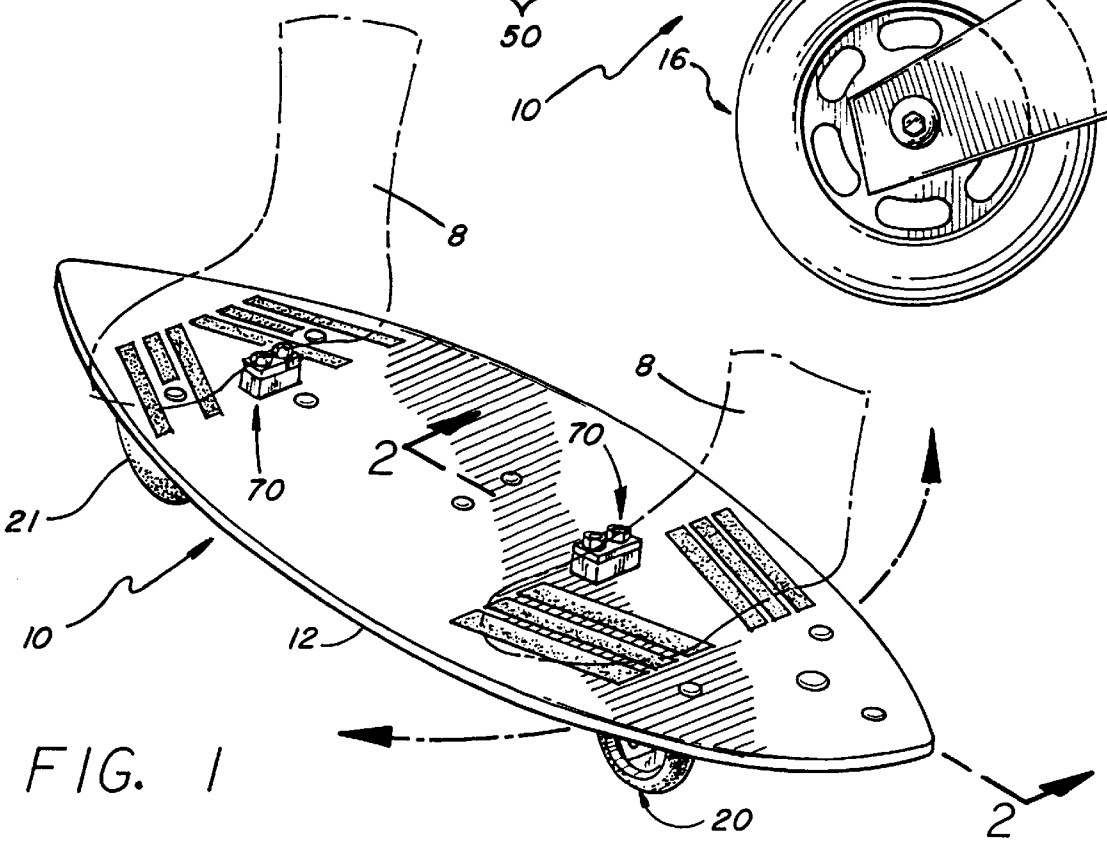
FIG. 1 is a perspective view of a two-wheeled skateboard according to an embodiment of the present invention.

With reference now to the drawings and more particularly to FIG. 1, a perspective view of rider 8 riding skateboard 10 is illustrated according to an embodiment of the present invention. Rider 8 positions his feet about respective outer sides of (optional) foot peg assemblies 70 during operation. Skateboard 10 requires greater skill during operation than a conventional four-wheeled skateboard because a minimum forward velocity is required to maintain balance. This aspect of the present invention is similar to a bicycle or scooter.

To ride skateboard 10, rider 8 places one foot on top of platform 12 and pushes against the ground with the other foot to set skateboard 10 in motion. Once skateboard 10 is in motion, rider 8 places the second foot on platform 12 and steers by shifting balance back and forth, i.e. tacking.

Skateboard 10 includes pivoting front wheel assembly 20 and non-pivoting rear wheel assembly 21. By shifting weight, rider 8 first moves the front of skateboard 10 sideways in a first direction with respect to rear wheel assembly 21. Rider 8 then moves the front of skateboard 10 sideways in a direction reverse to the first direction to maintain forward movement. Front wheel assembly 20 and rear wheel assembly 21 remain on the ground during this forward tacking operation.

Figure 2:
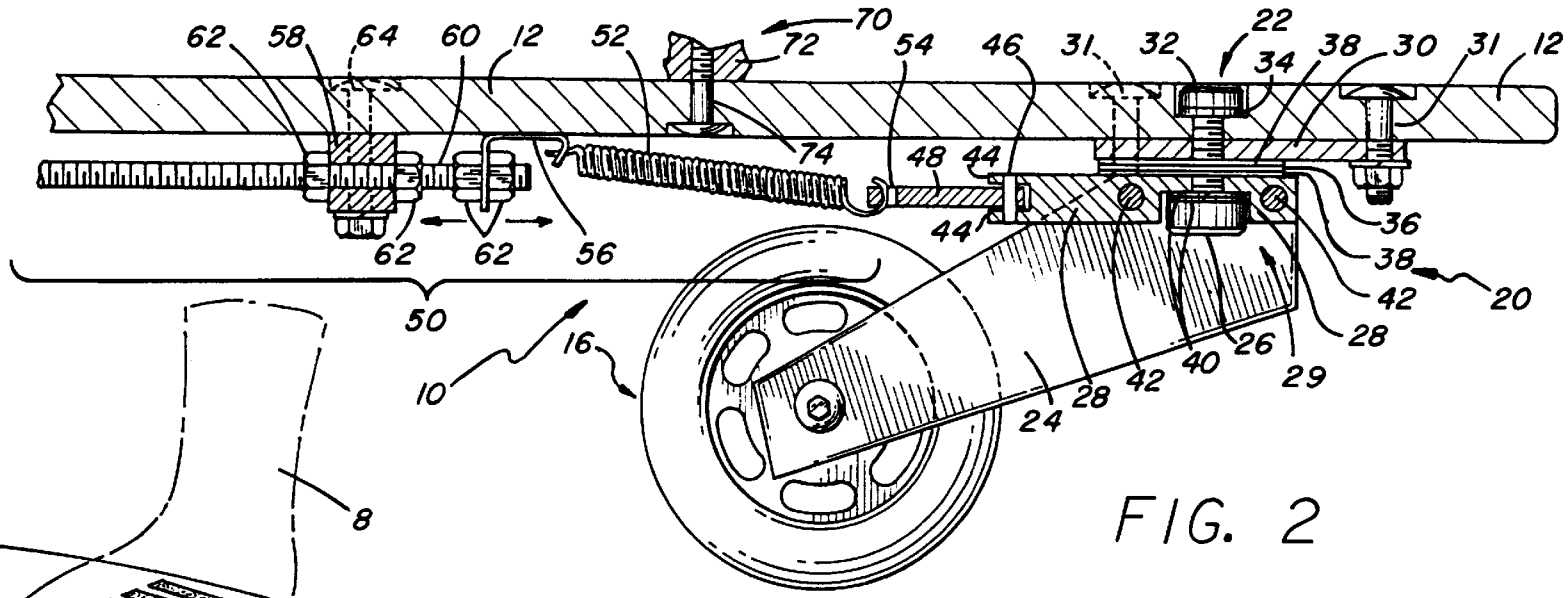
FIG. 2 is a sectional view of the two-wheeled skateboard taken along line 2—2 of FIG. 1.
Figure 3:
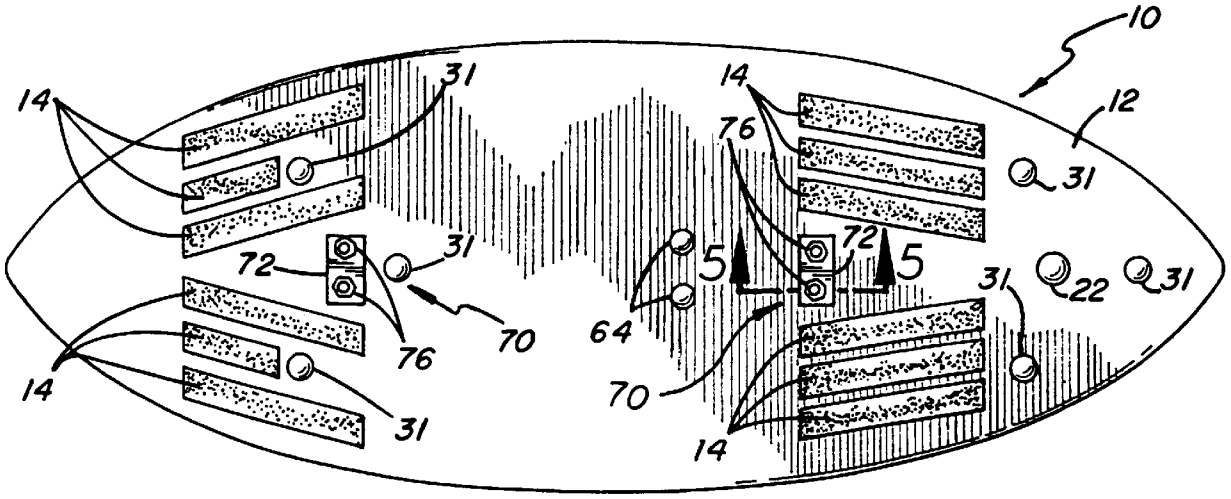
FIG. 3 is an elevated top view of a two-wheeled skateboard having optional foot pegs according to an embodiment of the present invention.
Figure 4:
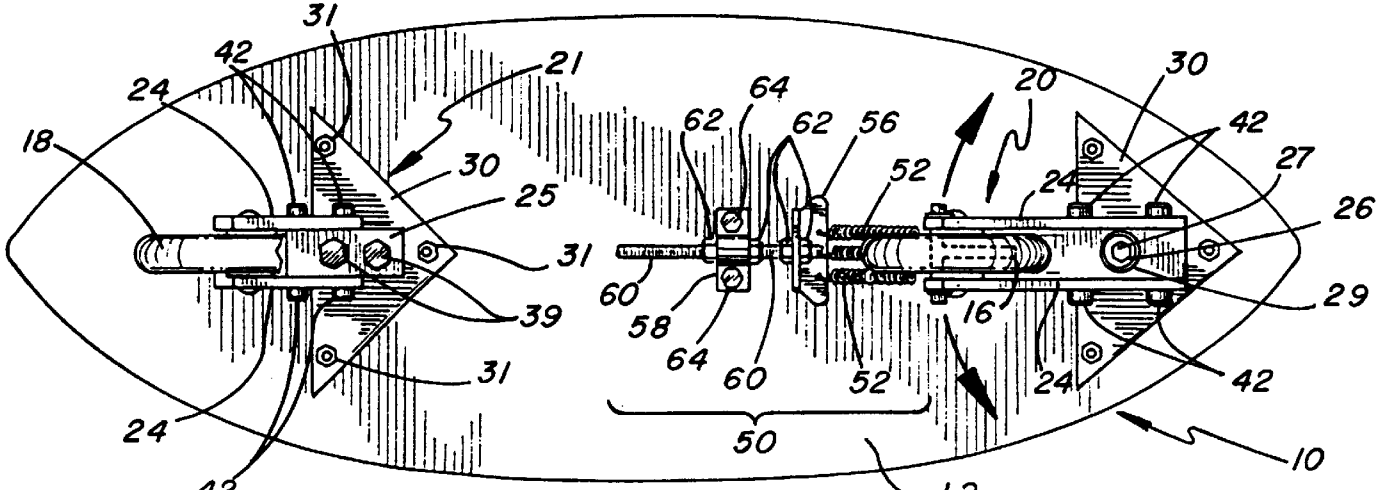
FIG. 4 is an elevated bottom view of a two-wheeled skateboard according to an embodiment of the present invention.

FIG. 2 is a cross sectional view of skateboard 10 illustrating front wheel assembly 20 taken along line 2—2 of FIG. 1. FIG. 3 is an elevated top view of skateboard 10 while FIG. 4 is an elevated bottom view. Referring now to FIGS. 2, 3, and 4, an in particular to FIG. 2, front wheel assembly 20 includes a pair of front wheel supports 24 which are attached to rotatable block 28 by a plurality of securing bolts 42. Rotatable block 28 is in turn connected to platform 12 by pivot assembly 22. Pivot assembly 22 includes shoulder bolt 26.

Shoulder bolt 26 passes through rotatable block 28, triangular block 30, and platform 12 before being secured by locking nut 32. Locking nut 32 secures the distal end of shoulder bolt 26 such that rotatable block 28 may rotate with respect to triangular block 30 and platform 12. Triangular block 30 is held securely to platform 12 by a plurality of bolts 31. Referring in particular to the front of platform 12 in FIG. 2, a first bolt 31 is illustrated by a section through platform 12. A second bolt 31 is illustrated in outline form in platform 12. Bolts 31 include a number of corresponding washers and nuts as illustrated.

Referring to FIG. 4, shoulder bolt 26 includes hex shaft 27 disposed within the top thereof for receiving a standard Allen wrench during tightening of locking nut 32. Shoulder bolt 26 may optionally screw into threads within triangular block 30 for extra support. As illustrated in FIG. 2, washer 34 is disposed between platform 12 and locking nut 32. Washer 34 is optionally a locking washer. In an alternative embodiment, the recess for shoulder bolt 26 in platform 12 may be enlarged such that locking nut 32 and washer 34 directly contact triangular block 30. In this case, contact between pivot assembly 22 and platform 12 is eliminated. Triangular block 30 is secured to platform 12 by a plurality of bolts 31.

Referring to FIG. 2, pivot assembly 22 includes a number of washers interposed between triangular block 30 and rotatable block 28. Primary washer 36 is disposed between a pair of containment washers 38. All three washers are then disposed between triangular plate 30 and rotatable block 28. According to a preferred embodiment, primary washer 36 is made from Teflon® and containment washers 38 are made from a polymer such as Nylon®. Primary washer 36 is made from Teflon® to provide a high resistance to heat and a relatively low frictional value. Containment washers 38 are made from Nylon®, because of its relatively low frictional value. However, all washers 36 and 38 could be made from Teflon®, or all from Nylon®. However, if all three washers are made from Nylon®, the performance characteristics will be reduced due to increased heat and friction. Containment washers 36 may also be manufactured from polypropylene, which has increased lubrication over Nylon®.

A pair of rotatable washers 40 are also disposed between shoulder bolt 26 and rotatable block 28. Rotatable washers 40 may be made from conventional metal. Rotatable washers 40 and shoulder bolt 26 fit within circular recess 29 of rotatable block 28. Rotatable washers 40 provide a number of lubricating surfaces between shoulder bolt 26 and rotatable block 28 to assist in rotation of rotatable block 28. A relatively expensive washer such as primary washer 36 is not needed between rotatable washers 40 because the primary weight of platform 11 is supported by primary washer 36. Although not shown, additional washers and spacers may be employed without departing form the inventive concept. Moreover, other washer configurations will become readily apparent to those skilled in the art.

With reference to FIGS. 2 and 4, front wheel assembly 20 includes rotatable block 28 disposed between a pair of front wheel supports 24. Rotatable block 28 includes a hole through which shoulder bolt 26 passes. Rotatable block 28 rotates about shoulder bolt 26 during operation of rider 8. Front wheel supports 24 are bolted onto rotatable block 28 by way of a plurality of securing bolts 42. However, a number of other securing means will be readily apparent to those skilled in the art. Rotatable block 28 also includes a pair of projections 44 alternately projecting from the top and bottom thereof toward the rear of platform 12. Projections 44 are preferably continuous projections from rotatable block 28. Referring to FIG. 2, pin 46 connects between projections 44.

Pin 46 pivotally connects to rear tension assembly 50. Tension assembly 50 provides a restoring force to front wheel assembly 20 after pivotal movement thereof.

Figures 6, 7, 8:
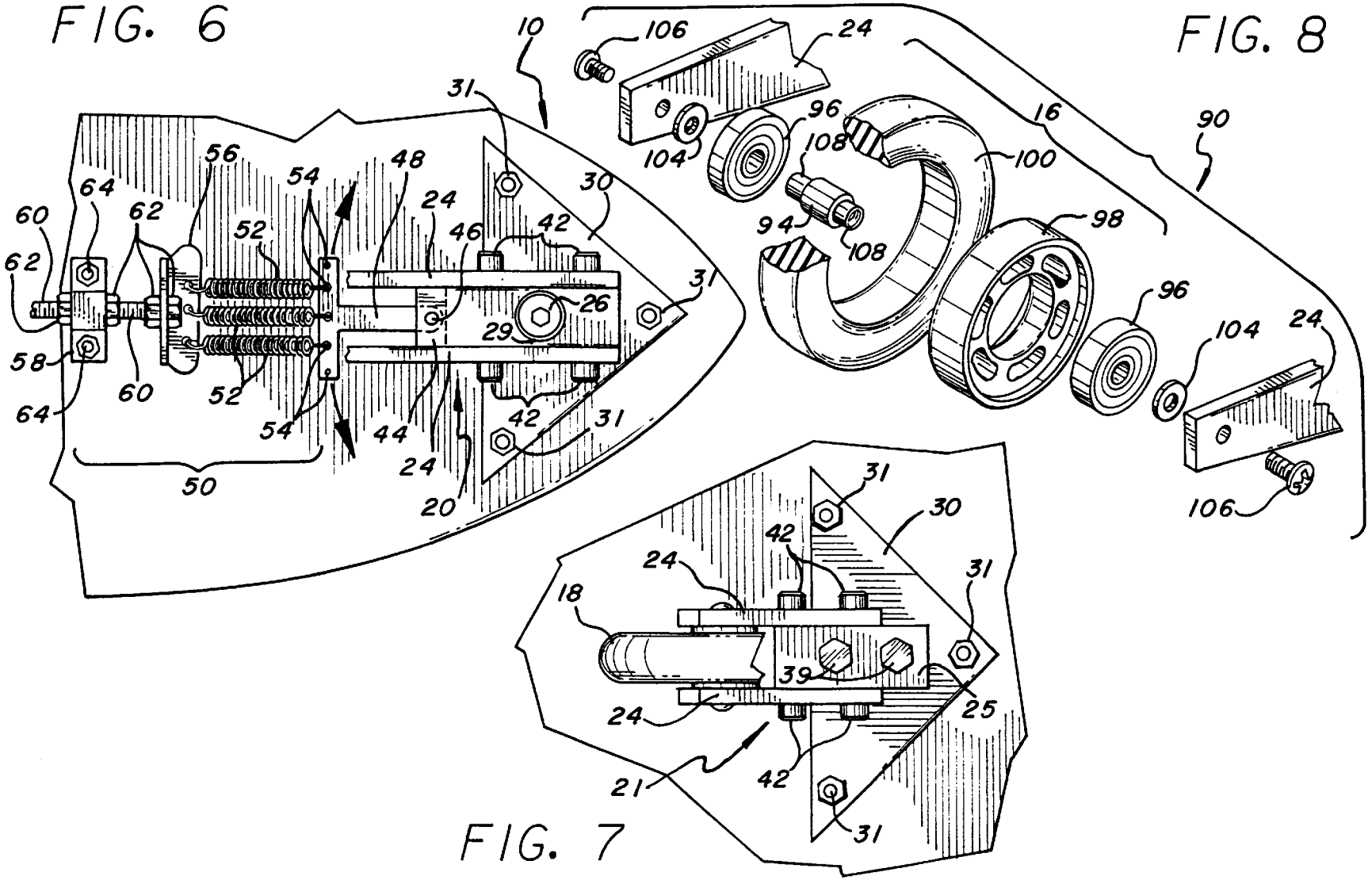
FIG. 6 is an elevated bottom view of a skateboard with its front wheel removed according to an embodiment of the present invention.
FIG. 7 is an elevated bottom view of a rear wheel assembly of a two-wheeled skateboard according to an embodiment of the present invention.
FIG. 8 is a blown apart perspective view of a skateboard wheel according to an embodiment of the present invention.

FIGS. 2, 4 and 6 respectively illustrate various views of tension assembly 50. Tension assembly 50 includes a plurality of springs 52 which are preferably configured to removably attach to connecting member 48. As illustrated in FIG. 6, connecting member 48 is a "T" shape. Connecting member 48 includes a plurality of connecting holes 54 disposed therein. Springs 52 are removably attached to mounting plate 56 at a first end and are secured to connecting member 48 through connecting holes 54. Springs 52 preferably have a tension value of 26.7 lb/in. Further, according to a preferred embodiment, three springs are used to provide an appropriate amount of tension. However, other spring combinations may be used and may be adjusted for the weight and skill of the rider.

Connecting member 48 is preferably a metal member which connects springs 52 with rotatable block 28. Connecting member 48 pivots with respect to rotatable block 28 about pin 46. The inventor has found that the distance between pin 46 and the pivot axis extending through shoulder bolt 26 is critical to optimum operation of the above invention. According to a preferred range, the inventor has found that the distance between pin 46 and shoulder bolt 26 is preferably between 1" and 4". More preferably the distance should be between 1.5" and 3" with the preferred distance being 2".

Tension assembly 50 also includes mounting plate 56. Mounting plate 56 itself floats freely beneath platform 12. Mounting plate 56 is attached to securing bracket 58 (which is secured to platform 12) by threaded rod 60 and a plurality of locking nuts 62. Threaded rod 60 may be adjusted with respect to securing bracket 58 by adjusting locking nuts 62. Securing bracket 58 itself is fastened to platform 12 by a pair of bolts 64 and a pair of corresponding nuts as illustrated.

Tension assembly 50 provides a restoring force to skateboard 10 during pivoting or tacking of rider 8. During operation, tension assembly maintains stability of front wheel assembly 20 thereby reducing "wobble" of front wheel 16. Many factors cooperate for effective operation of tension assembly 50 including placement of pin 46, tension of springs 52, and the ability of springs 52 to slightly pivot with respect to mounting plate 56. Additionally, springs 52 are allowed to pivot with respect to their connections to connecting member 48. Accordingly, three main pivoting areas cooperate under tension to promote a stable ride at high speeds. It is noted, of course, that rotatable block 28 pivots with respect to shoulder bolt 46 while remaining aligned with wheel supports 24. Tension assembly 50 cooperates with the angle of wheel supports 24 to provide further stability to the rider at high speeds.

Figure 5:
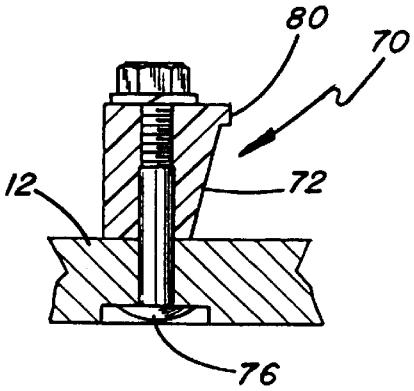
FIG. 5 is a cross sectional view of a skateboard foot peg according to an embodiment of the present invention.

FIGS. 1, 3, and 5 illustrate respective views of optional foot peg assemblies 70. Skateboard 10 includes two foot peg assemblies 70 so that feet of rider 8 may find additional support for greater control. Foot peg assemblies 70 may be configured to assist the rider in gripping onto skateboard 10 during acrobatic stunts and maneuvers. Each foot peg assembly 70 includes foot peg 72 which is secured to platform 12 by a pair of securing bolts 76 and corresponding locking nuts and washers. A shoulder portion of securing bolt 74 is disposed within a circular recess in platform 12 to present a flush surface. Foot peg 72 is preferably made from a commercially available polymer, however a number of other materials may be used.

Foot peg 72 may include protrusion 80 for assisting a rider's foot grip during acrobatic stunts and maneuvers. By gripping both foot peg assemblies 70 with the feet, rider 8 may lift skateboard 10 off the ground. Because rider 8 will generally prefer to place his feet over the wheels of the skateboard, foot peg assemblies 70 are generally placed to complement the riders preferred foot placement thereon. It should be noted that foot peg assemblies 70 may be removed while the rider is learning to ride skateboard 10, thereby reducing the possibility of injury during use.

FIGS. 1 and 3 also illustrate a plurality of optional abrasive sections 14. Rider 8 places his feet upon abrasive sections 14 to reduce the possibility of slippage. Abrasive sections 14 may be made from adhesive tape which has an abrasive outer surface.

Figure 9:
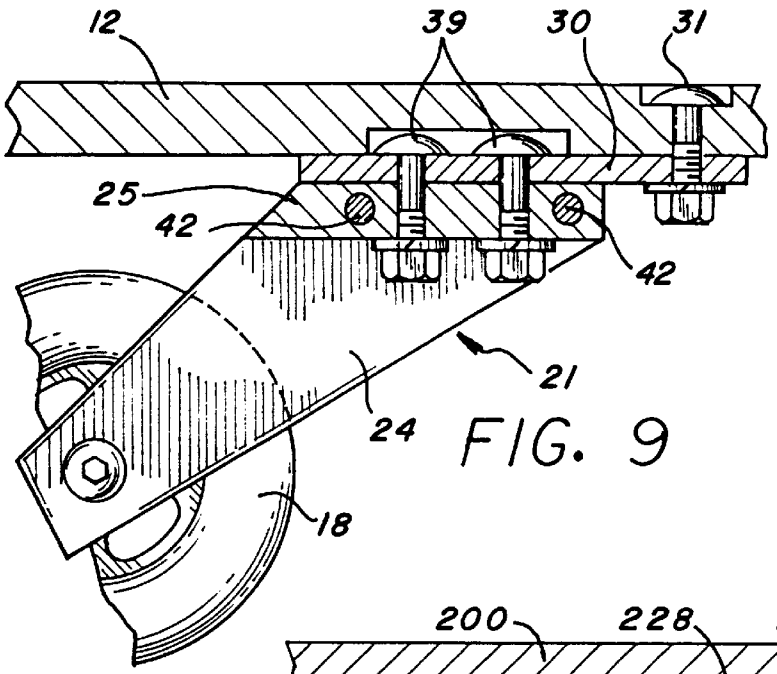
FIG. 9 is a partial sectional view of a rear wheel assembly according to an embodiment of the present invention.

FIGS. 4, 7 and 9 illustrate rear wheel assembly 21 attached to platform 12. FIG. 7 illustrates a more detailed, elevated bottom view of rear wheel assembly 21, while FIG. 9 illustrates a sectional view. Referring now to FIGS. 4 and 7, rear wheel 18 is attached between wheel supports 24. Wheel supports 24 are in turn attached to fixed plate 25 by way of a plurality of bolts 42. Fixed plate 25 is attached to triangular block 30 by a pair of bolts 39. Rear wheel assembly 21 does not pivot with respect to platform 12.

FIG. 9 illustrates rear wheel assembly 21 according to an embodiment of the present invention. Rear wheel assembly 21 includes wheel 18 which is supported by a pair of rear wheel supports 24. Rear wheel supports 24 do not pivot about an axis. Instead, rear wheel supports 24 are affixed to fixed plate 25. Fixed plate 25 is similar to rotatable block 28, however fixed plate 25 does not pivot. Rear wheel supports 24 are attached to fixed plate 25 by securing bolts 42. Fixed plate 25 is securely affixed to triangular block 30 by bolts 39 and corresponding nuts and washers. Triangular block 30 is then affixed to platform 12 by a plurality of bolts 31 and accompanying locking nuts and washers.

Front wheel assembly 20 and rear wheel assembly 21 cooperate to provide motion to skateboard 10 as a result of tacking. The inventor has found through experimentation that forward movement is generated by providing a lateral force to rear wheel assembly 21. Thus, rear wheel assembly 21 is continually subjected to oscillating lateral forces during operation of skateboard 10. If rear wheel assembly 21 were allowed to pivot, the lateral fores applied thereto from the tacking motion of the front of skateboard 10 would be absorbed and forward motion would be severely reduced.

FIG. 8 illustrates a blown apart perspective view of wheel group 90. Wheel group 90 forms a part of front wheel assembly 20 and rear wheel assembly 21. Wheel group 90 is attached between front wheel supports 24 (illustrated FIGS. 2, 4, and 6) and likewise between rear wheel supports 24 (illustrated in FIG. 7). Wheel group 90, as illustrated, includes front wheel 16, spacer 94 and a pair of sealed bearings 96. Wheel 16 further includes supporting disk 98 and solid tire 100. Spacer 94 is configured and arranged to fit within the interior of supporting disk 98 without contacting the surface thereof. Sealed bearings 96 fit over ends 108 of spacer 94 and directly contact the interior surface of interior supporting disk 98.

A pair of washers 104 are alternately displaced on outer sides of sealed bearings 96. Washers 104 then respectively contact wheel supports 24. Securing bolts 106 respectively pass through holes within wheel supports 24 and washers 104, then lock into respective threads disposed within the ends of spacer 94.

The material of front wheel 16 and rear wheel 18 are very important to optimize the performance of skateboard 10. Wheel 16 has a durometer hardness which is between 84 A and 94 A. A durometer hardness range between 86 A and 90 A is more preferably with a durometer hardness of 88 A being most preferred. If the wheel 16 is too hard, the wheel will not adequately grip the riding surface, i.e. the road. Moreover, if wheel 16 is too soft, there will be excessive wear. It should be noted, however, that some wear of each of wheels 16 and 18 is to be expected. Moreover, the inventor has found through experimentation that the rear wheel will experience more wear than the front wheel during operation. Thus, skateboard 10 may be provided with a rear wheel 18 which is slightly harder than the front wheel 16 to reduce the amount of wear.

Figure 10A:
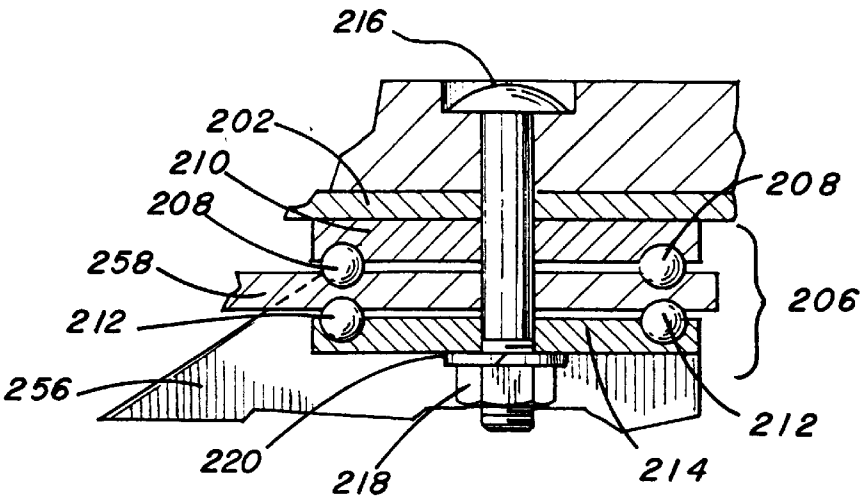
FIG. 10A is a detailed sectional view of the front wheel assembly of FIG. 10.
Figure 10:
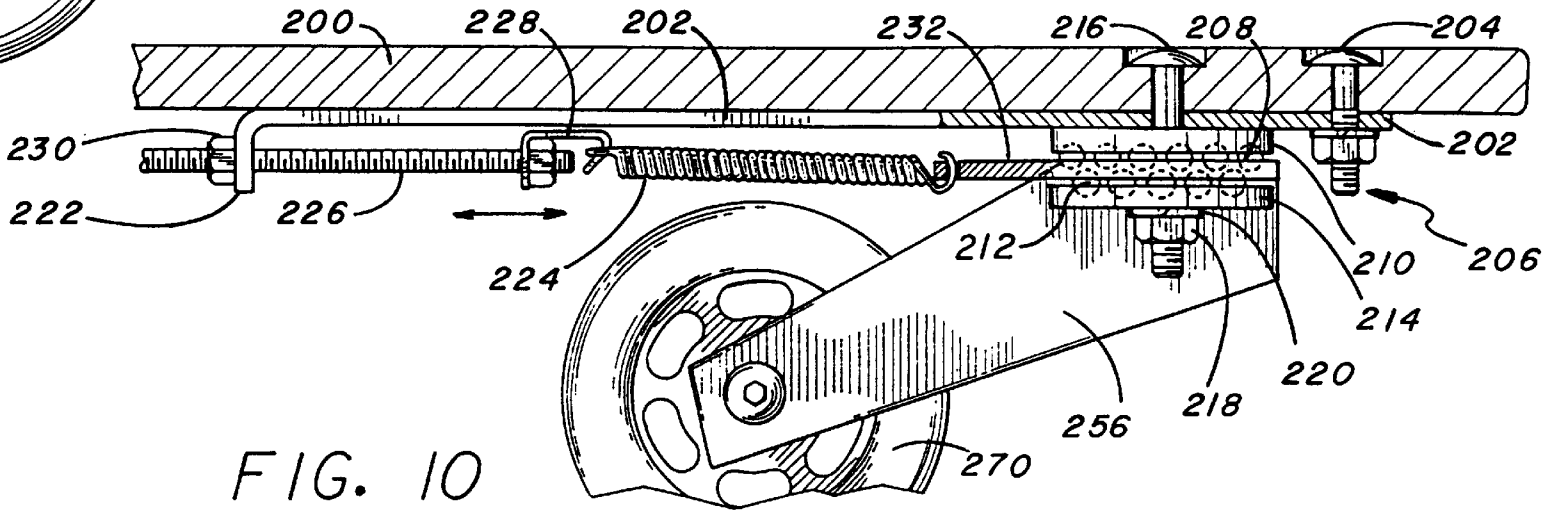
FIG. 10 is a sectional view of a front wheel assembly according to another embodiment of the present invention.
Figure 12:
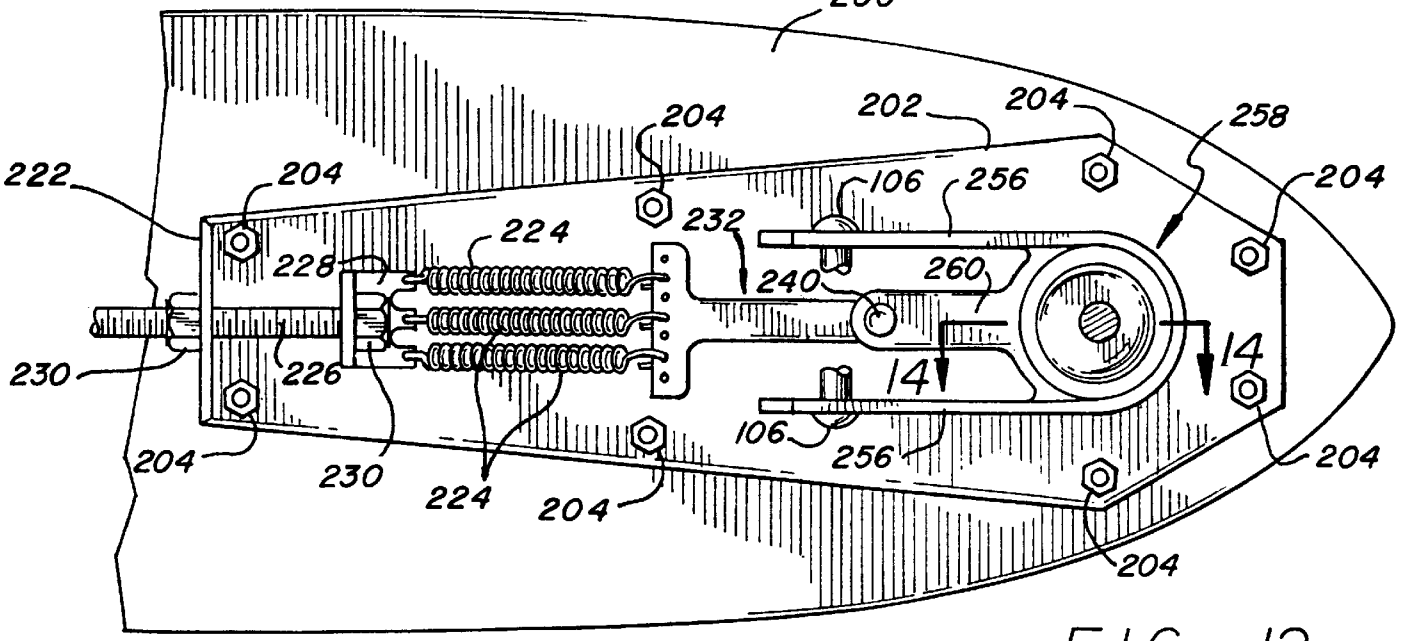
FIG. 12 is an elevated bottom view of a skateboard with a front wheel removed according to an embodiment of the present invention.

FIGS. 10, 10A, and 12 illustrate a two-wheeled skateboard according to a second preferred embodiment of the present invention. FIGS. 10 and 10A illustrate an embodiment wherein a number of components have been replaced by components which are more efficient, when compared with FIG. 2, and may be specially produced in large quantity. From a manufacturing perspective, the second embodiment illustrated in FIG. 12 is more cost effective because many of the components may be stamped from sheet metal.

According to FIGS. 10, 10A, and 12, the second embodiment of the present invention includes front plate 202 which is affixed to platform 200 by a plurality of securing means such as bolts 204. A first plurality of bearings 208 forms a part of caster assembly 206 and is disposed between caster base 258 and first bearing retainer 210. Caster 206 assembly rotates with respect to front plate 202 by way of the first plurality of bearings 208. First bearing retainer 210 is disposed adjacent to and contacts front plate 202.

A second plurality of bearings 212 forms a part of caster assembly 206 and is disposed between caster base 258 and second bearing retainer 214. Caster assembly 206 pivots about central bolt 216 by way of first plurality of bearings 208 and second plurality of bearings 212. Central bolt 216 is held in place by locking nut 218 and washer 220. According to another embodiment of the invention, central bolt 216 may be replaced by a rivet which is well known in the art.

Referring now to FIG. 12, front plate 202 includes curved rear portion 222 which serves as an anchor for threaded rod 226. Threaded rod 226 is secured into curved rear portion 222 by adjustment nut 230. A plurality of additional nuts and washers may also be used. Threaded rod 226 is secured into mounting plate 228 by another locking nut 230 but may also be secured by a plurality of nuts and washers. Mounting plate 228 is not directly attached to front plate 202 but floats freely underneath. Springs 224 are attached to mounting plate 228. Adjustment nut 230 adjusts the spring tension of springs 224. A plurality of adjustment nuts may also be used. Springs 224 are attached to caster assembly 206 by clevis 232.

Figure 11A:
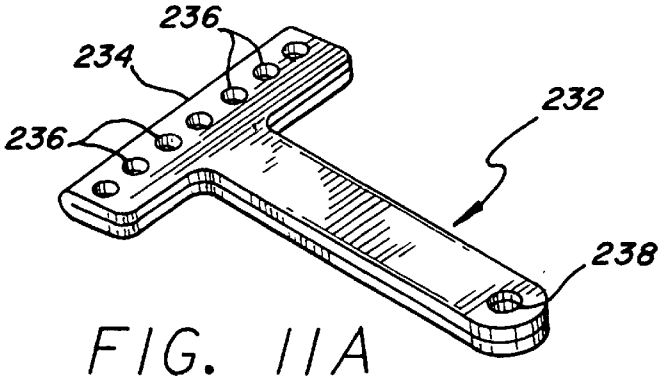
FIG. 11A is a perspective view of a manufactured clevis illustrated in FIG. 11.
Figure 11:
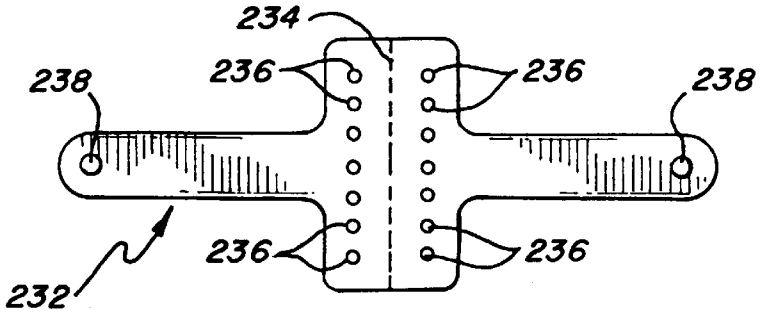
FIG. 11 an elevated top view of a clevis stamping according to an embodiment of the present invention.

Clevis 232 is preferably a metal stamping as illustrated in FIGS. 11 and 11A. Referring now to FIG. 11A, clevis 232 is bent about axis 234. Clevis 232 includes a plurality of spring holes 236 and a pair of fastener holes 238. Rivet 240 extends through fastener holes 238 and fastens clevis 232 to caster 206.

Figure 13:
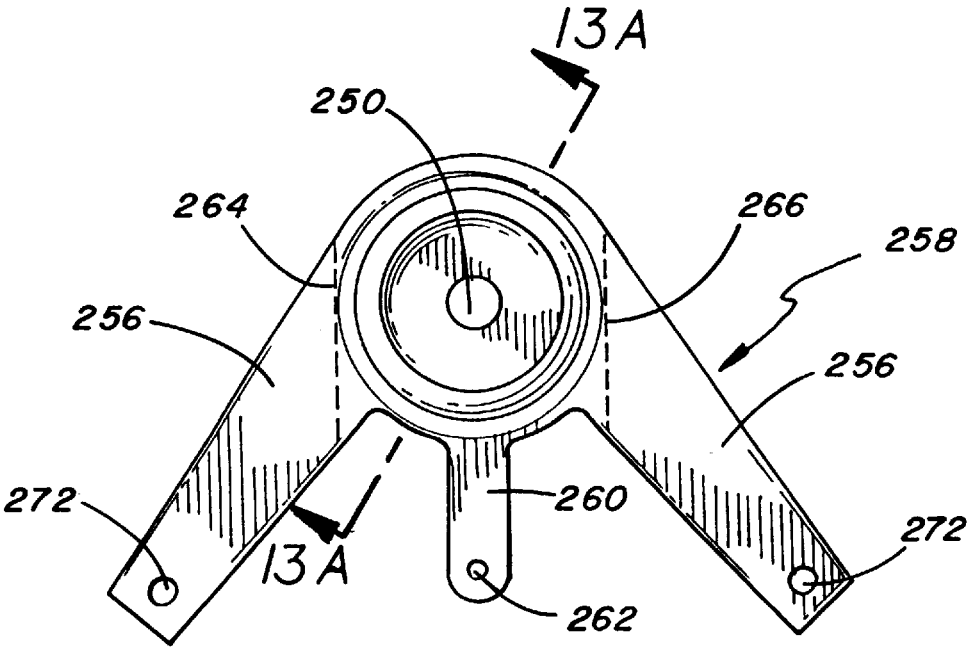
FIG. 13 is an elevated bottom view of a caster base according to an embodiment of the present invention.
Figure 13A:
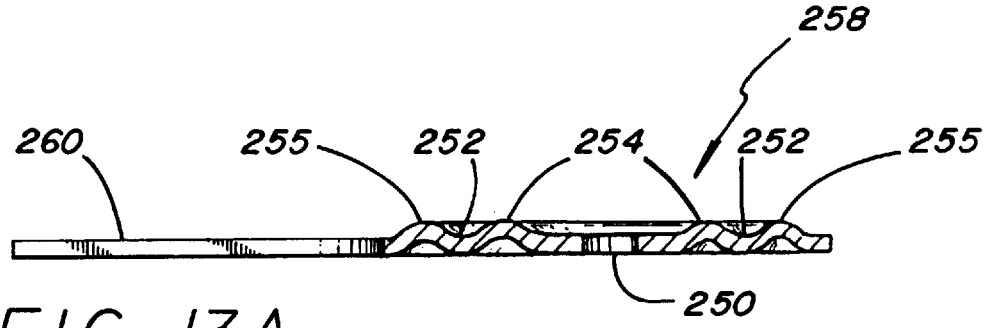
FIG. 13A is a cross sectional view of the caster base illustrated in FIG. 13.

FIGS. 13 and 13A illustrate caster base 258 after metal stamping but prior to orthogonal bending along first axis 264 and second axis 266. Caster base 258 includes central hole 250 through which central bolt 216 passes. Central hole 250 is surrounded by bearing trough 252 about which inner bearing ridge 254 and outer bearing ridge 255 are disposed. Caster base 258 also includes a pair of wheel supports 256 which extend orthogonally therefrom. Caster base 258 also includes lip 260 and rivet hole 262 which is attached to fastener holes 238 in clevis 232 by way of rivet 240. Front wheel 270 is affixed to wheel supports 256 in caster base 258 by mounting holes 272 as set forth in the first embodiment.

Figure 14:
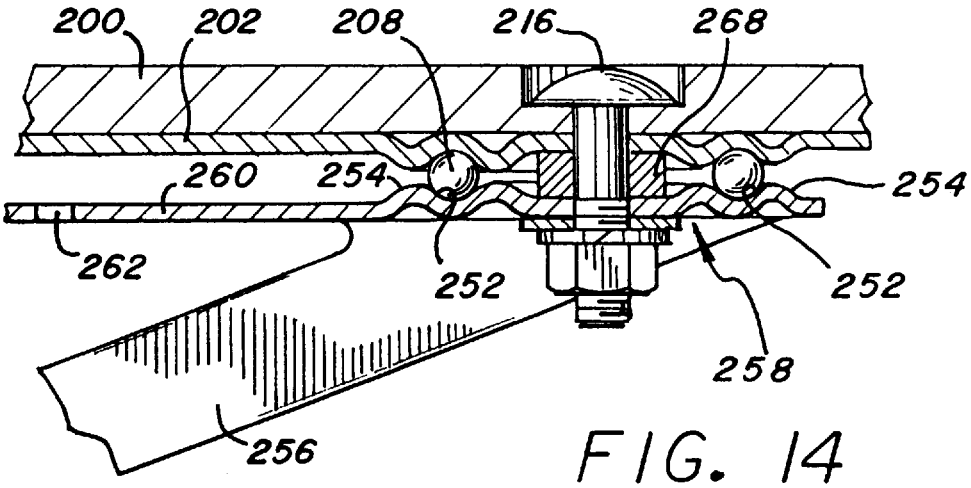
FIG. 14 is a detailed cross sectional view of a pivot assembly according to an embodiment of the present invention.

FIG. 14 illustrates pivot assembly 22 according to yet another embodiment of the present invention. According to FIG. 14, pivot assembly 22 includes a stamped front plate 202 which includes bearing trough 252 therein. According to this embodiment, the need for a separate first bearing retainer 210 can be eliminated thereby reducing costs associated with manufacture. Wheel supports 256, caster lip 260 and rivet hole 262 remain the same as illustrated in FIG. 10A. According to the embodiment of FIG. 14, a single row of bearings are required. In this case, caster base 258 forms the second bearing retainer to thereby secure bearings 208 in place. As illustrated in FIG. 14, optional spacer washer 268 is disposed between front plate 202 and caster base 258.

The foregoing is considered as illustrative only of the principles of the invention, and since numerous modifications and changes will readily occur to those skilled in the art, it is not desired to limit the invention to the exact construction and operation shown and described, and accordingly, all suitable modifications and equivalents may be resorted to, falling within the scope of the present invention.

I claim:

1. A two-wheeled foot vehicle, comprising:

a board which is generally planar between a first position and a second position, said board defining a first planar section which is so configured and arranged to directly support the heel and ball of a first foot of a rider in a lateral direction of said board and said board defining a second planar section which is so configured and arranged to directly support the heel and ball of a second foot of the rider in the lateral direction of said board simultaneously with the first foot;

a front wheel assembly attached to said board at the first position, said front wheel assembly further comprising:

a front wheel support being rotationally pivotable with respect to said board about a wheel support pivot axis; and a tension member connected to the front wheel support and connected to said board at a connected position between the first position and the second position; and a rear wheel assembly attached to said board at the second position, wherein the front wheel support is connected to a single front wheel disposed entirely below said board and the rear wheel assembly is connected to a single rear wheel disposed entirely below said board such that the two wheels do not extend beyond an outer perimeter of said board and the total number of wheels connected to the two-wheeled foot vehicle consists of two.

2. The two-wheeled foot vehicle according to claim 1, further comprising:

a clevis connected to the tension member by a first clevis axis and connected to the front wheel support by a second clevis axis such that a restoring tension is applied to the front wheel towards a longitudinal axis of the board through the first and second clevis axes while the front wheel assembly pivots with respect to said board.

3. The two-wheeled foot vehicle according to claim 1, said front wheel assembly further comprising a second tension member connected to the front wheel support and connected to said board between the first position and the second position, wherein the two-wheeled foot vehicle is operable with the first foot of the rider supported at the first planar section and the second foot of the rider supported at the second planar section during operation thereof, and the two-wheeled foot vehicle is steerable by tilting said board with respect to a riding surface through said placement of said two wheels below said board and within the outer perimeter of said board.

4. The two-wheeled foot vehicle according to claim 1, wherein the diameter of the front wheel is less than the width of said board at the first position and the diameter of the rear wheel is less than the width of said board at the second position.

5. The two-wheeled foot vehicle according to claim 1, further comprising:

an adjustable member connected to the tension member and said board such that the amount of force exerted by the tension member on the front wheel support may be increased or decreased through adjustment.

6. The two-wheeled foot vehicle according to claim 1 wherein the wheel durometer hardness is between 84 A and 94 A.

7. The two-wheeled foot vehicle according to claim 6 wherein the wheel durometer hardness is between 86 A and 90 A.

8. The two-wheeled foot vehicle according to claim 7 wherein the wheel durometer hardness is 88 A.

9. The two-wheeled foot vehicle according to claim 1, wherein the two-wheeled foot vehicle is operable by the rider with the first and second foot in contact with said board such that a second board is not used.

10. The two-wheeled foot vehicle according to claim 1, further comprising:

a pair of foot pegs extending upwardly from the top surface of said board such that the rider may position the rider's feet adjacent to the pair of foot pegs.

11. The two-wheeled foot vehicle according to claim 1, further comprising:

a caster base attached to the front wheel support and pivoting with respect to said board about the wheel support pivot axis;

a front plate connected to said board and disposed between said board and the caster base; and a rotatable bearing disposed between the caster base and the front plate thereby enhancing pivotal rotation therebetween.

12. The two-wheeled foot vehicle according to claim 1, further comprising a first abrasive section affixed to said board at the first position and a second abrasive section affixed to said board at the second position, wherein the two-wheeled foot vehicle is operable with the first foot of the rider supported at the first planar position and the second foot of the rider supported at the second planar position during operation thereof.

13. The two-wheeled foot vehicle according to claim 1, wherein the two-wheeled foot vehicle is propellable by the rider without removing either of the first foot or the second foot from said board, such that the front of said board is adapted to move sideways in a first direction with respect to said rear wheel assembly in response to a shifting of the rider's weight in a first shifting direction, and the front of said board is adapted to move sideways in a second direction traverse to the first direction while the front wheel and the rear wheel remain in contact with a riding surface in response to a shifting of the rider's weight in a second shifting direction.

14. The two-wheeled foot vehicle according to claim 13, wherein said board is tiltable in a first tilting direction during the shift of weight in the first direction and is tiltable in a second tilting direction during the shift of weight in the second direction.

15. The two-wheeled foot vehicle according to claim 1, wherein said rear wheel assembly does not pivot with respect to said board and forward movement of said board is generatable by continually subjecting said rear wheel assembly to oscillating lateral forces with the rear wheel in contact with a riding surface.

16. The two-wheeled foot vehicle according to claim 1, wherein said board has a front end and a rear end, said board being generally planar between the first position and the front end and generally planar between the second position and the rear end.

17. The two-wheeled foot vehicle according to claim 1, said rear wheel assembly further comprising:

a rear wheel support which does not pivot with respect to said board, wherein the front wheel support is angled away from said board and toward the second position and the rear wheel support is angled away from said board and away from the first position.

18. A tiltable two-wheeled foot vehicle, comprising:

a board which is generally planar between a first position and a second position, said board defining a first planar section which is so configured and arranged to directly support the heel and ball of a first foot of a rider in a lateral direction of said board and said board defining a second planar section which is so configured and arranged to directly support the heel and ball of a second foot of the rider in the lateral direction of said board;

a connection member attached to said board;

a front wheel assembly attached to said board through connection to said connection member, said front wheel assembly pivotable about a front wheel support pivot axis, said front wheel assembly including:

a front wheel support connected to said connection member and rotationally pivotable about the front wheel support pivot axis;

a front wheel group of elements, grouped into a single front wheel which rotates with respect to the front wheel support, said front wheel including:

a front wheel support disk having a circular outer perimeter and defining a hole about a rotational axis of the front wheel support disk;

a front wheel first sealed bearing having an outer perimeter which is so configured and arranged to be removably received within the hole of the front wheel support disk, the front wheel first sealed bearing connected to the front wheel support and rotating about a rotational axis of the front wheel first sealed bearing;

a front wheel second sealed bearing having an outer perimeter which is so configured and arranged to be removably received within the hole of the front wheel support disk, the front wheel second sealed bearing connected to the front wheel support and rotating about a rotational axis of the front wheel second sealed bearing;

a front wheel spacer removably disposed within the hole of the front wheel support disk, the front wheel spacer being so configured and arranged to mate with the front wheel first sealed bearing and the front wheel second sealed bearing to maintain separation upon receipt within the hole of the front wheel support disk; and a front wheel annular tire having a circular outer periphery and defining a hole about a rotational axis of the front wheel annular tire, the hole of the front wheel annular tire being so configured and arranged to mate with the outer perimeter of the front wheel support disk; and a rear wheel assembly attached as part of the two-wheeled foot vehicle such that said rear wheel assembly does not pivot with respect to said board, said rear wheel assembly including:

a rear wheel support attached as part of the two-wheeled foot vehicle such that said rear wheel support does not pivot with respect to said board, said rear wheel support providing a rotational connection to a single rear wheel;

a rear wheel group of elements, grouped into the single rear wheel which rotates with respect to the rear wheel support about said rotational connection, said rear wheel including:

a rear wheel support disk having an outer perimeter and defining a hole about a rotational axis of the rear wheel support disk;

a rear wheel first sealed bearing having a circular outer perimeter which is so configured and arranged to be removably received within the hole of the rear wheel support disk, the rear wheel first sealed bearing connected to the rear wheel support and rotating about a rotational axis of the rear wheel first sealed bearing;

a rear wheel second sealed bearing having an outer perimeter which is so configured and arranged to be removably received within the hole of the rear wheel support disk, the rear wheel second sealed bearing connected to the rear wheel support and rotating about a rotational axis of the rear wheel second sealed bearing;

a rear wheel spacer removably disposed within the hole of the rear wheel support disk, the rear wheel spacer being so configured and arranged to mate with the rear wheel first sealed bearing and the rear wheel second sealed bearing to maintain separation upon receipt within the hole of the rear wheel support disk; and a rear wheel annular tire having a circular outer periphery and defining a hole about a rotational axis of the rear wheel annular tire, the hole of the rear wheel annular tire being so configured and arranged to mate with the outer perimeter of the rear wheel support disk, wherein the total number of wheels connected to the two-wheeled foot vehicle consists of two, wherein said board is tiltable in a first tilting direction with respect to the ground and tiltable in a second tilting direction traverse to the first direction during operation thereof, wherein the diameter of the front wheel is less than the width of said board between the first position and the second position and the diameter of the rear wheel is less than the width of said board between the first position and the second position, and wherein the two-wheeled foot vehicle is operable by the rider with the first and second foot in contact with said board such that a second board is not used.

19. The two-wheeled foot vehicle according to claim 18, wherein the wheel durometer hardness of the front wheel is between 84 A and 94 A and the wheel durometer hardness of the rear wheel is between 84 A and 94 A.

20. The two-wheeled foot vehicle according to claim 19, wherein the wheel durometer hardness of the front wheel is between 86 A and 90 A and the wheel durometer hardness of the rear wheel is between 86 A and 90 A.

21. The two-wheeled foot vehicle according to claim 20, wherein the front wheel support is angled with respect to the first planar section of said board.

22. The two-wheeled foot vehicle according to claim 19, wherein the front wheel support is angled with respect to the first planar section of said board.

23. The two-wheeled foot vehicle according to claim 18, wherein the front wheel support is angled with respect to the first planar section of said board.

24. The two-wheeled foot vehicle according to claim 18, further comprising:

a tension assembly connected to said front wheel assembly and connected to said board at a connected position between the first position and the second position, said tension assembly including:

a clevis having a front portion defining a first clevis axis and having a rear portion defining a second clevis axis, said clevis rotatably connected to said front wheel assembly about the first clevis axis;

a mounting plate non-rotationally connected to said board, the mounting plate defining a mounting plate axis; and an elastic tension member connecting the second clevis axis with the mounting plate axis, such that the elastic tension member provides a restoring tension to urge the front wheel toward a longitudinal axis of said board while said front wheel assembly pivots with respect to said board, the restoring tension being applied to the front wheel through the mounting plate axis, the first clevis axis, the second clevis axis, and the wheel support pivot axis.

25. A two-wheeled foot vehicle, comprising:

a board which is generally planar between a first position and a second position, said board defining a first planar section which is so configured and arranged to directly support the heel and ball of a first foot of a rider in a lateral direction of said board, and said board defining a second planar section which is so configured and arranged to directly support the heel and ball of a second foot of the rider in the lateral direction of said board, said board also defining an outer perimeter;

a front wheel assembly attached to said board at the first position, said front wheel assembly including a front wheel support rotationally pivotable with respect to said board about a wheel support pivot axis;

a tension assembly connected to said front wheel assembly and connected to said board at a connected position between the first position and the second position, said tension assembly including:

a clevis having a front portion defining a first clevis axis and having a rear portion defining a second clevis axis, said clevis rotatably connected to said front wheel assembly about the first clevis;

a mounting plate non-rotationally connected to said board, the mounting plate defining a mounting plate axis; and an elastic tension member connecting the second clevis axis with the mounting plate axis, such that the elastic tension member provides a restoring tension applied to urge the front wheel assembly toward a longitudinal axis of said board while said front wheel assembly pivots with respect to said board, the restoring tension being applied to the front wheel through the mounting plate axis, the first clevis axis, the second clevis axis and the wheel support pivot axis; and a rear wheel assembly attached to said board at the second position, wherein the front wheel support is connected to a single front wheel and the rear wheel assembly is connected to a single rear wheel such that the total number of wheels connected to the two-wheeled foot vehicle consists of two wheels, and wherein the single front wheel and the single rear wheel are disposed entirely below said board and disposed entirely within the outer perimeter of said board.

26. The two-wheeled foot vehicle according to claim 25, wherein the single front wheel includes:

a front wheel support disk having an outer perimeter and defining a hole about a rotational axis of the front wheel support disk;

a front wheel first sealed bearing having an outer perimeter which is so configured and arranged to be removably received within the hole of the front wheel support disk, the front wheel first sealed bearing connected to the front wheel support and rotating about a rotational axis of the front wheel first sealed bearing;

a front wheel second sealed bearing having an outer perimeter which is so configured and arranged to be removably received within the hole of the front wheel support disk, the front wheel second sealed bearing connected to the front wheel support and rotating about a rotational axis of the front wheel second sealed bearing;

a front wheel spacer removably disposed within the hole of the front wheel support disk, the front wheel spacer being so configured and arranged to mate with the front wheel first sealed bearing and the front wheel second sealed bearing to maintain separation upon receipt within the hole of the front wheel support disk; and a front wheel annular tire having a circular outer periphery and defining a hole about a rotational axis of the front wheel annular tire, the hole of the front wheel annular tire being so configured and arranged to mate with the outer perimeter of the front wheel support disk; and the single rear wheel includes:

a rear wheel support disk having an outer perimeter and defining a hole about a rotational axis of the rear wheel support disk;

a rear wheel first sealed bearing having an outer perimeter which is so configured and arranged to be removably received within the hole of the rear wheel support disk, the rear wheel first sealed bearing connected to the rear wheel support and rotating about a rotational axis of the rear wheel first sealed bearing;

a rear wheel second sealed bearing having an outer perimeter which is so configured and arranged to be removably received within the hole of the rear wheel support disk, the rear wheel second sealed bearing connected to the rear wheel support and rotating about a rotational axis of the rear wheel second sealed bearing;

a rear wheel spacer removably disposed within the hole of the rear wheel support disk, the rear wheel spacer being so configured and arranged to mate with the rear wheel first sealed bearing and the rear wheel second sealed bearing to maintain separation upon receipt within the hole of the rear wheel support disk; and a rear wheel annular tire having a circular outer periphery and defining a hole about a rotational axis of the rear wheel annular tire, the hole of the rear wheel annular tire being so configured and arranged to mate with the outer perimeter of the rear wheel support disk.

27. The two-wheeled foot vehicle according to claim 25, wherein the two-wheeled foot vehicle is propellable by the rider without removing either of the first foot or the second foot from said board, such that the front of said board is adapted to move sideways in a first direction with respect to said rear wheel assembly in response to a shifting of the rider's weight in a first shifting direction, and the front of said board is adapted to move sideways in a second direction traverse to the first direction while the front wheel and the rear wheel remain in contact with a riding surface in response to a shifting of the rider's weight in a second shifting direction; and said board is tiltable in a first tilting direction during the shift of weight in the first direction and is tiltable in a second tilting direction during the shift of weight in the second direction.

28. The two-wheeled foot vehicle according to claim 25, wherein said rear wheel assembly does not pivot with respect to said board and forward movement of said board is generatable by continually subjecting said rear wheel assembly to oscillating lateral forces with the rear wheel in contact with a riding surface; and said board has a front end and a rear end, said board being generally planar between the first position and the front end and generally planar between the second position and the rear end.

29. A two-wheeled skateboard, comprising:

a single board which is generally planar between a first position and a second position, such that a rider may continually operate the two-wheeled skateboard with the rider's first and second foot placed directly on said single board;

a front wheel assembly attached to said board at the first position, said front wheel assembly further comprising:

a front wheel support being rotationally pivotable with respect to said board about a wheel support pivot axis; and a tension member connected to the front wheel support and connected to said board at a connected position between the first position and the second position; and a rear wheel assembly attached to said board at the second position, wherein the front wheel support is connected to a single front wheel and the rear wheel assembly is connected to a single rear wheel such that the total number of wheels connected to the two-wheeled skateboard consists of two.

* * * * *